US008463159B2

(12) United States Patent
Nakagami et al.

(10) Patent No.: US 8,463,159 B2
(45) Date of Patent: Jun. 11, 2013

(54) IMAGE FORMING UNIT AND IMAGE FORMING APPARATUS INCLUDING ELASTICALLY DEFORMABLE CHARGING ROLLER

(75) Inventors: Hidekazu Nakagami, Toyohashi (JP); Yoshinori Tanaka, Sakai (JP); Fuminori Moro, Toyokawa (JP); Yasuhiro Suzuki, Toyokawa (JP); Naoki Matsui, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 593 days.

(21) Appl. No.: 12/393,130

(22) Filed: Feb. 26, 2009

(65) Prior Publication Data

US 2009/0311005 A1 Dec. 17, 2009

(30) Foreign Application Priority Data

Jun. 16, 2008 (JP) ..... 2008-156318

(51) Int. Cl.
*G03G 15/02* (2006.01)

(52) U.S. Cl.
USPC ..... 399/115

(58) Field of Classification Search
USPC ..... 399/115, 168, 174, 176
See application file for complete search history.

(56) References Cited

U.S. PATENT DOCUMENTS

| | | | | |
|---|---|---|---|---|
| 4,851,960 | A | | 7/1989 | Nakamura et al. |
| 5,534,344 | A | * | 7/1996 | Kisu et al. |
| 5,822,169 | A | * | 10/1998 | Yoshioka et al. |

FOREIGN PATENT DOCUMENTS

| | | | | |
|---|---|---|---|---|
| JP | 63-149669 | A | | 6/1988 |
| JP | 03130787 | A | * | 6/1991 |
| JP | 04076569 | A | * | 3/1992 |
| JP | 05072869 | A | * | 3/1993 |
| JP | 7-191523 | A | | 7/1995 |
| JP | 09211935 | A | * | 8/1997 |
| JP | 10-333400 | A | | 12/1998 |
| JP | 11-160955 | | | 6/1999 |
| JP | 11149199 | A | * | 6/1999 |
| JP | 11258888 | A | * | 9/1999 |
| JP | 2002-304103 | | | 10/2002 |
| JP | 2006-163197 | A | | 6/2006 |

OTHER PUBLICATIONS

Preliminary Notice of Rejection issued in the corresponding Japanese Patent Application No. 2008-156318 dated Apr. 13, 2010, and an English Translation thereof.

* cited by examiner

*Primary Examiner* — Walter L Lindsay, Jr.
*Assistant Examiner* — Milton Gonzalez
(74) *Attorney, Agent, or Firm* — Buchanan Ingersoll & Rooney PC

(57) ABSTRACT

An image forming unit is provided with a regulating member placed in such a way as to surround a charging roller to regulate movement thereof. The regulating member has a pressing section inclined with respect to a straight line connecting the center of the charging roller to the axis of the photoconductor, as seen from the axial direction of the photoconductor. The pressing section is inclined farther away from the photoconductor toward upstream of rotation of the photoconductor. The regulating member allows the charging roller to electrically charge the photoconductor with a simplified structure and prevents adhering substances from accumulating on the contact portion between the photoconductor and the charging roller.

16 Claims, 22 Drawing Sheets

IMAGE FORMING UNIT AND IMAGE FORMING APPARATUS INCLUDING ELASTICALLY DEFORMABLE CHARGING ROLLER

CROSS-REFERENCE TO RELATED APPLICATION

This application is based on application No. 2008-156318 filed in Japan, the entire content of which is hereby incorporated by reference.

BACKGROUND OF THE INVENTION

The present invention relates to an image forming apparatus such as electrophotographic copying machines, printers and facsimiles, and to an image forming unit used for the image forming apparatus.

One of conventional image forming units is provided with a rotatable photoconductor and a charging roller which has a shaft to contact with the outer face of the photoconductor (see JP 63-149669 A). This charging roller is put into pressure contact with the photoconductor by e.g. a spring which presses the shaft toward the photoconductor, so that the charging roller rotates following the rotation of the photoconductor. The charging roller applies electric charge to the photoconductor.

Another conventional image forming unit applies electric charge to a photoconductor by bringing a charging sheet into contact with the photoconductor (see JP 07-191523 A).

However, cost has increased in the case of the firstly-stated conventional image forming unit where the charging roller is provided with the shaft. Also, the structure becomes complicated because members such as springs are required so as to bring the charging roller in pressure contact with the photoconductor.

In the case of the secondly-stated conventional image forming unit where the charging sheet is brought into contact with the photoconductor, there has been a problem that image noises are generated by abnormal electric discharges due to deposits. The deposits are adhering substances accumulated on the contact portion between the charging sheet and the photoconductor. Specifically, they are toners, post-processing agents for toners, paper powders and the like which have passed through a cleaning blade.

BRIEF SUMMARY OF THE INVENTION

An object of the present invention is to provide an image forming unit and an image forming apparatus which can electrically charge a photoconductor with a simplified structure and which can prevent adhering substances from accumulating on the contact portion between the photoconductor and a charging roller.

In order to achieve the above-mentioned object, one aspect of the present invention provides an image forming unit, comprising a rotatable photoconductor; an elastically deformable charging roller for charging the photoconductor, which roller contacts with an outer face of the photoconductor and rotates following rotation of the photoconductor; and a regulating member for regulating movement of the charging roller, which member is placed so as to surround the charging roller, wherein the regulating member has a pressing section which contacts with the charging roller in a longitudinal direction of the charging roller to press the charging roller against the photoconductor during one-way rotation of the photoconductor and the charging roller, wherein the pressing section is inclined with respect to a direction of a line connecting a center of a cross-sectional circle of the charging roller to an axis of the photoconductor, as seen from an axial direction of the photoconductor in a state that the charging roller contacts with the pressing section, wherein the pressing section is inclined farther away from the photoconductor toward an upstream of the one-way rotation of the photoconductor, and wherein the charging roller, when pressed by the pressing section against the photoconductor during the one-way rotation of the photoconductor and the charging roller, assumes a generally elliptical shape in cross-section.

According to the above-stated image forming unit, the pressing section is inclined so as to be farther away from the photoconductor toward the upstream of the one-way rotation of the photoconductor. Combination of the pressing section and the photoconductor forms a wedge structure. When the photoconductor rotates, the charging roller goes into the wedge structure. Thereby, the charging roller is pressed toward the photoconductor. Thus, the charging roller is brought into deformed pressure contact with the photoconductor. As the result, the charging roller rotates at a constant speed, and thereby charges the photoconductor uniformly.

The charging roller rotates following the rotation of the photoconductor. Therefore, adhering substances such as toners and toner post-processing agents hardly accumulate on the contact portion between the photoconductor and the charging roller. This suppresses abnormal discharge due to the adhering substances.

Therefore, it becomes possible to electrically charge the photoconductor with a simplified structure and to prevent adhering substances from accumulating on the contact portion between the photoconductor and the charging roller.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

A

DETAILED DESCRIPTION OF THE INVENTION

Hereinbelow, embodiments of the present invention will be described in details with reference to the drawings by way of illustration.

First Embodiment

Figure 1A:
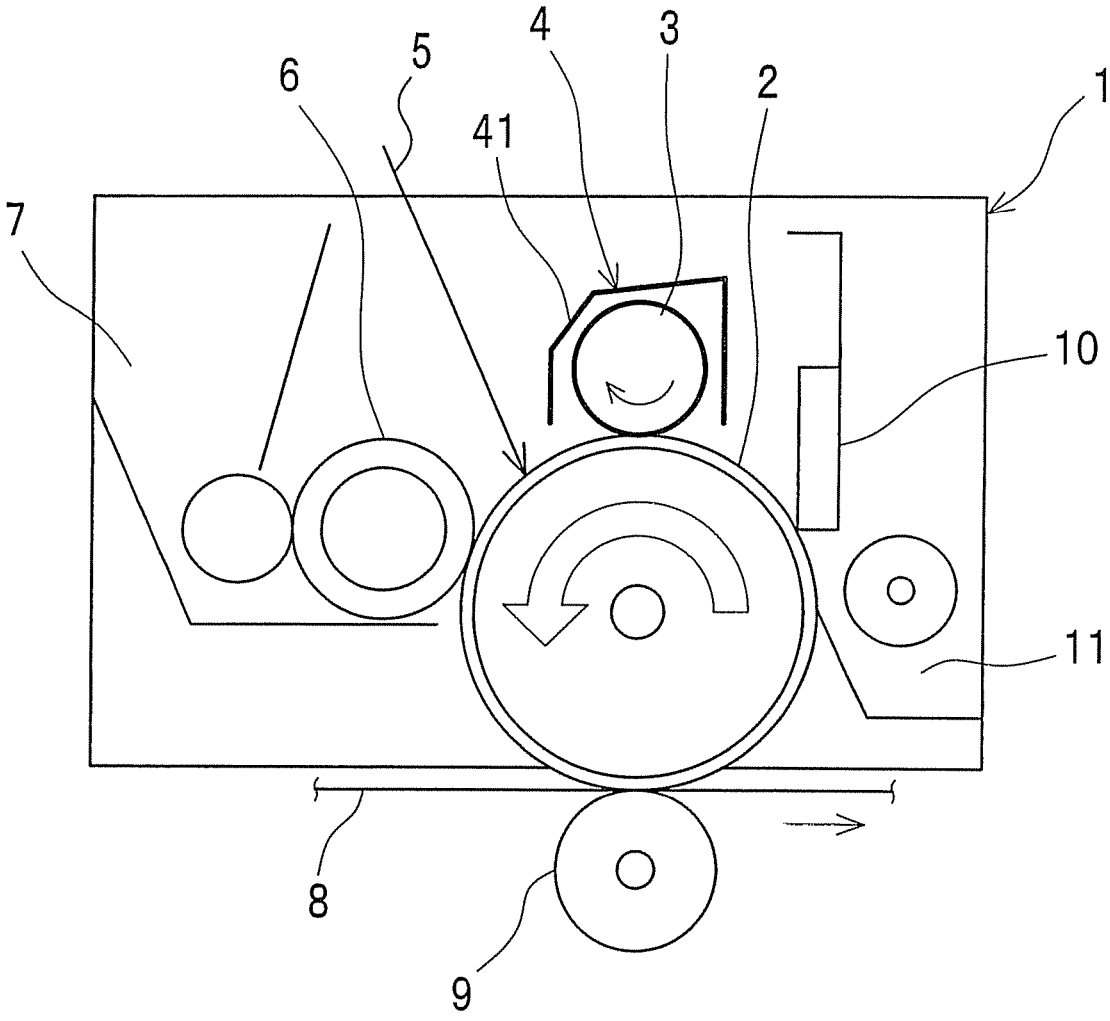
FIG. 1A shows a simplified schematic view of an image forming unit according to a first embodiment of the present invention.
Figure 2:
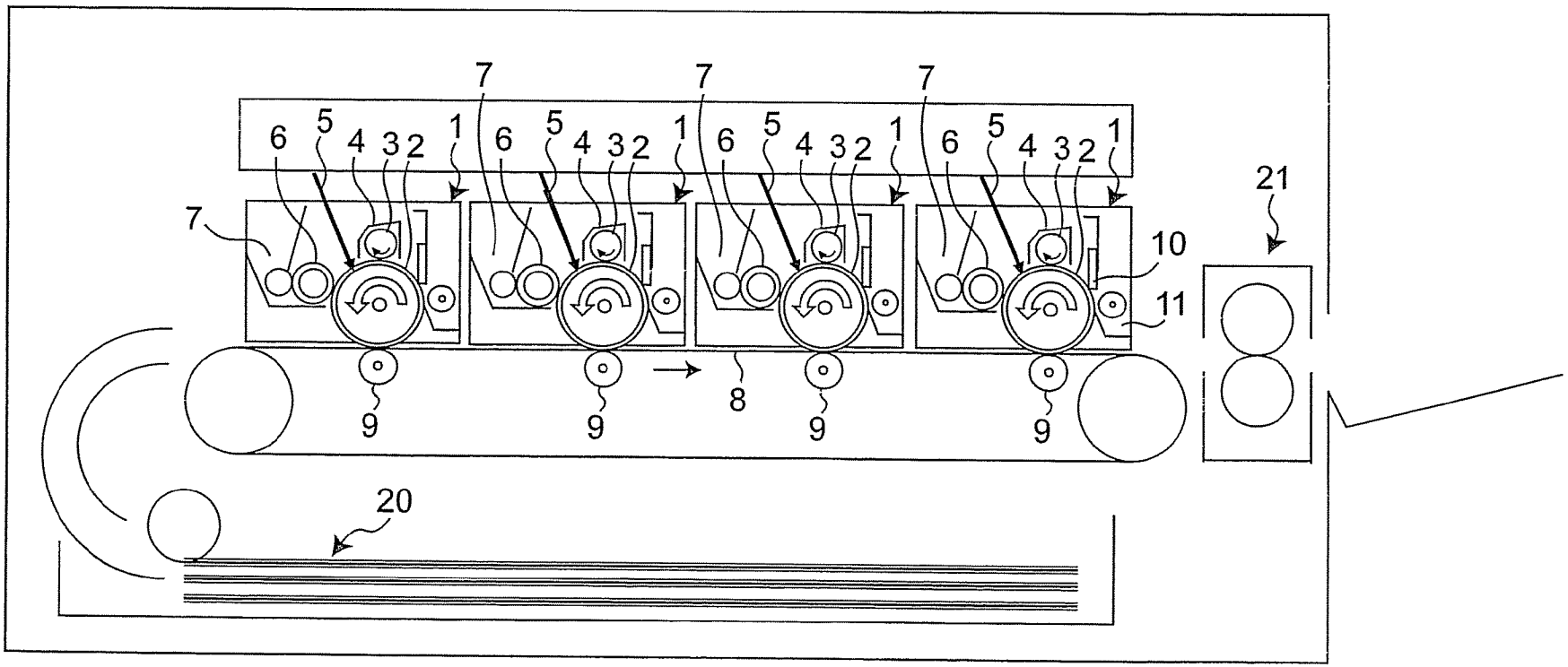
FIG. 2 shows a simplified schematic view of an image forming apparatus according to the invention.

An image forming unit 1 schematically shown in FIG. 1A is provided with a photoconductor 2, a charging roller 3, a regulating member 4 surrounding the charging roller 3, a developing section 6, a toner storing section 7, a cleaner blade 10 and a toner recovery section 11. The image forming unit 1 is detachable from an image forming apparatus shown in FIG. 2. A series of operations relating to image formation are performed under the control of the apparatus.

In image formation, the photoconductor 2 is uniformly charged by the charging roller 3. Based on image data, exposure is performed on the photoconductor 2 to form a latent image. Then, a toner image is formed on the photoconductor 2 in the developing section 6. An arrow 5 in the drawing shows that exposure is performed by an exposure means.

A primary transfer section 9 transfers the toner image, which is formed on the photoconductor 2, onto a paper sheet which is sent from a feed section 20 through a conveying belt 8. The paper sheet is then conveyed into a fixing device 21 to fix the toner image before the paper sheet is discharged.

Untransferred toner and other adhering substances remaining on the photoconductor 2 are scraped off by the cleaner blade 10. Wastes such as scraped-off toner are collected by the toner recovery section 11.

Charge voltage is inputted into the charging roller 3 via a conductive regulating member 4 or an unshown conductive member. Thereby, a targeted charge is applied to the photoconductor 2.

This image forming apparatus is a tandem-type image forming apparatus which uses the direct transfer method. An image forming unit 1 for forming toner images in black (BK), an image forming unit 1 for forming toner images in yellow (Y), an image forming unit 1 for forming toner images in magenta (M), and an image forming unit 1 for forming toner images in cyan (C) are placed in this order along from upstream to downstream of the conveying belt 8.

Figure 1B:
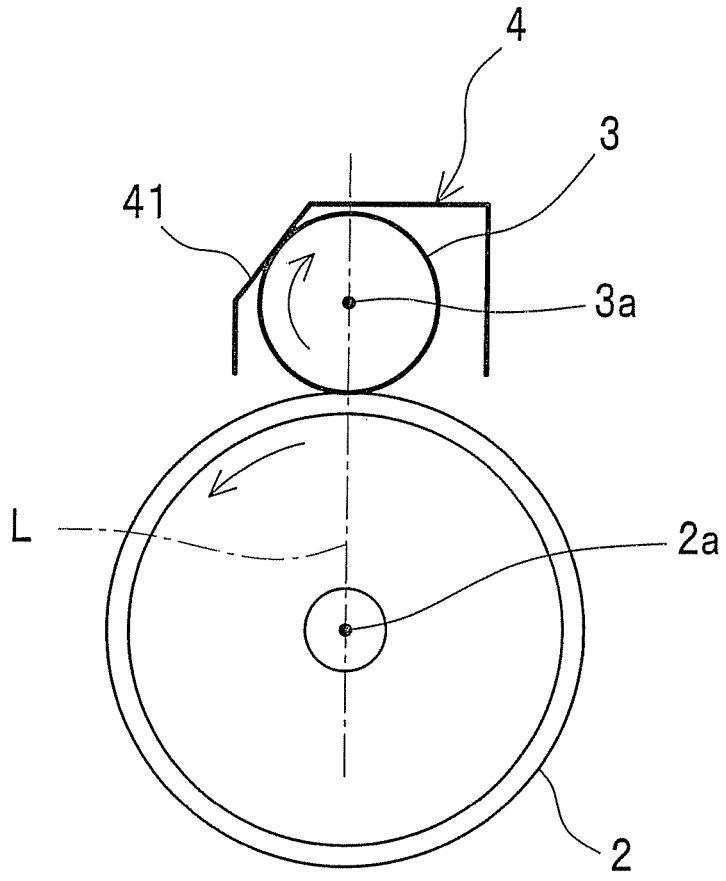
FIG. 1B shows an enlarged view of the image forming unit.

As shown in FIG. 1B, the photoconductor 2 has a drum shape and is rotatable around an axis 2*a* thereof. The charging roller 3 contacts with the outer face of the photoconductor 2 and rotates following the rotation of the photoconductor 2.

The charging roller 3 is an elastically deformable hollow roller which does not have a shaft. The charging roller 3 charges the photoconductor 2 and has a surface resistance of, for example, $10^5$ to $10^8\Omega$ and a thickness of, for example, 0.05 to 0.8 mm. The charging roller 3 is made of material such a conductive resin as PA, PI, PFA, PTFE, PPS or PC. The charging roller 3 may be made out of a tube of nonconductive resin coated with conductive material or conductive rubber.

The regulating member 4 is placed so as to surround the charging roller 3 to regulate movement of the charging roller 3. The regulating member 4 has such a size as to house the charging roller 3 in the free state. The regulating member 4 is made of, for example, stainless steel or iron plated with nickel. Herein, the free state is referred to as a state that the charging roller 3 maintains a cylindrical shape due to no force onto the charging roller from any direction.

The regulating member 4 has a front wall, a back wall, an upper wall, and a pressing section 41 which connects the upper wall and the front wall. The front is defined as a downstream side of one-way rotation (shown with a large arrow) of the photoconductor 2.

During one-way rotation of the photoconductor 2 and the charging roller 3, as shown in FIG. 1B, the regulating member 4 contacts with the charging roller 3 along a longitudinal direction of the charging roller 3. Then, the charging roller 3 is pressed against the photoconductor 2.

When the pressing section 41 is seen from the direction of an axis 2*a* of the photoconductor 2 in the state that the charging roller 3 contacts the pressing section 41, the pressing section 41 is inclined with respect to a direction L of the line connecting the center 3*a* of a cross-sectional circle the charging roller 3 to the axis 2*a* of the photoconductor 2.

The pressing section 41 is inclined so as to be father away from the photoconductor 2 toward an upstream side of the one-way rotation of the photoconductor 2.

Figure 3:
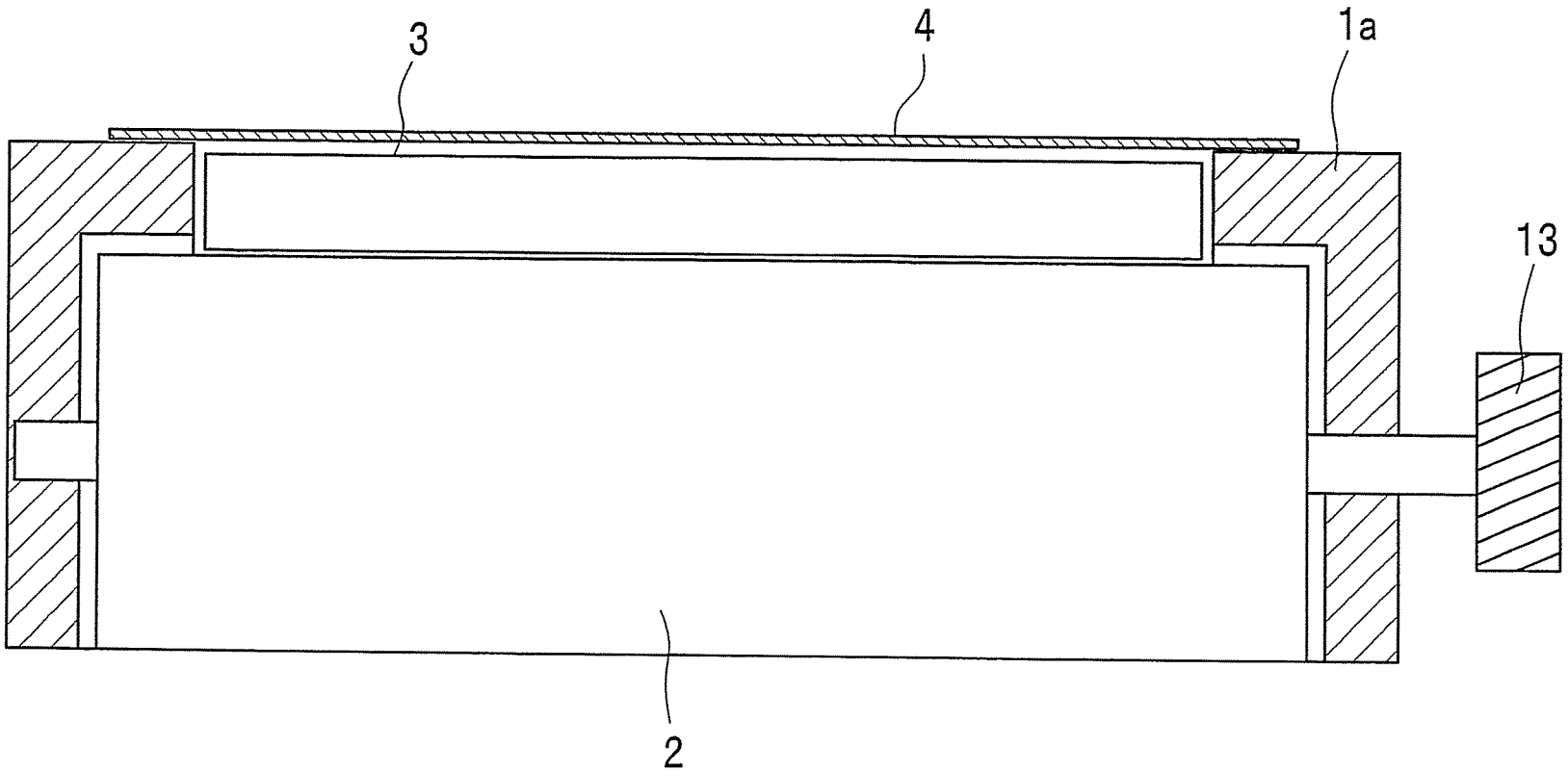
FIG. 3 shows a cross sectional rear view of the image forming unit.

As shown in the cross sectional rear view of FIG. 3, a shaft section of the photoconductor 2 is held by a casing 1*a*. The photoconductor 2 is rotated by driving a drive gear 13 mounted on the shaft section. The regulating member 4 is mounted on the casing 1*a*. The charging roller 3 is movably fitted in the space surrounded with the casing 1*a*, the regulating member 4 and the photoconductor 2.

The frictional resistance of the photoconductor 2 against the charging roller 3 is equal to or larger than the frictional resistance of the regulating member 4 against the charging roller 3. A portion of the regulating member 4, which contacts with the charging roller 3, may be provided with a slide member. The slide member is a Teflon tape, a dry lubricant or the like, for example.

Description is now given on the movement of the charging roller 3.

Figure 4:
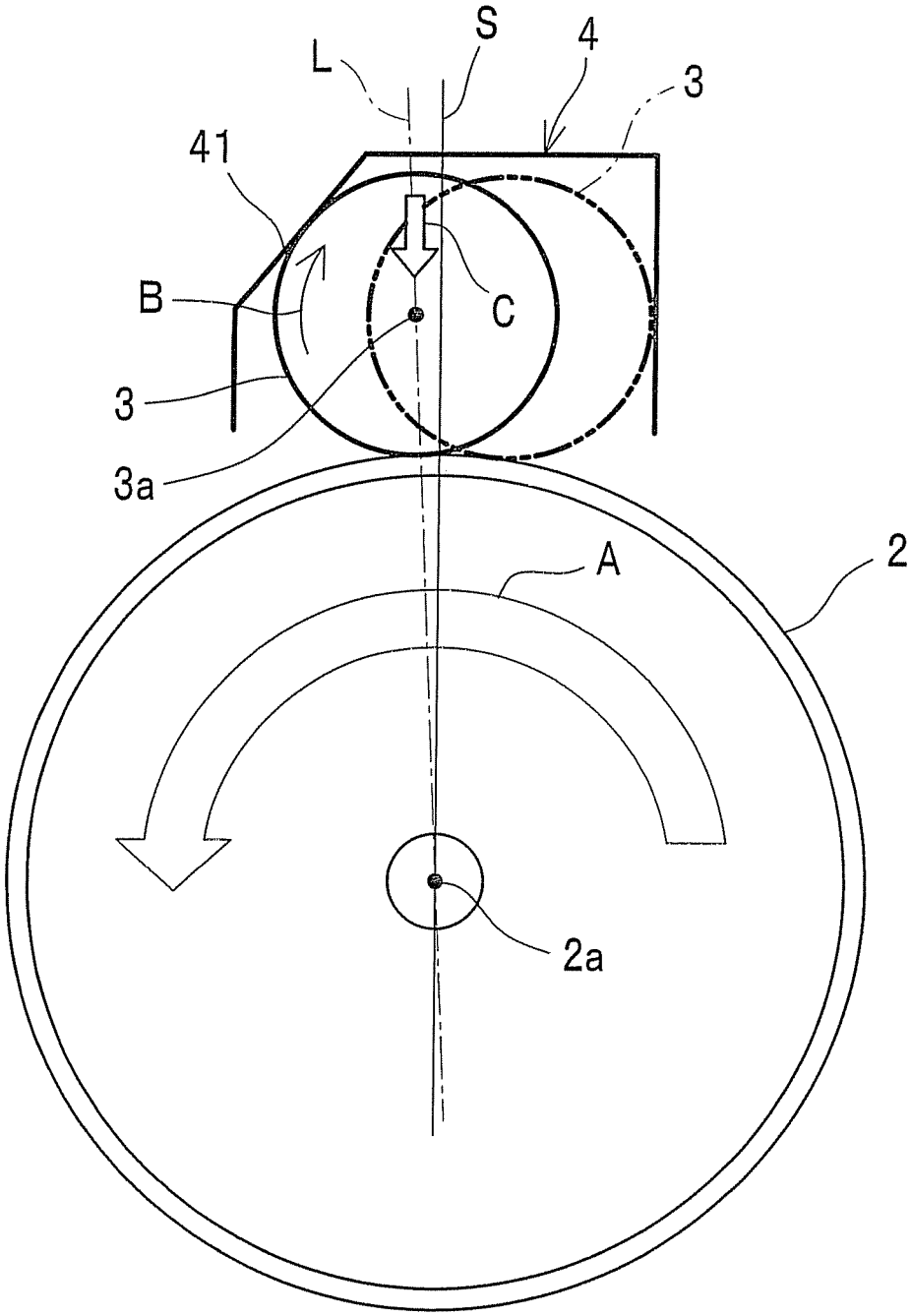
FIG. 4 shows a view for explaining the operation of the image forming unit.

As shown in FIG. 4, while the charging roller 3 is in light contact with the photoconductor 2, the charging roller 3 is moved forward (left side in the drawing) from the imaginary-line state to the solid-line state by following the arrow "A" directional (one directional) rotation of the photoconductor 2.

The center 3*a* of the slid-lined charging roller 3 shown by a solid line is positioned within 90 degrees of a central angle between a datum straight line S and a horizontal line passing through the axis 2*a* of the photoconductor 2 on the downstream side of the one-way rotation of the photoconductor 2, as seen from the direction of axis 2*a* of the photoconductor 2 in the state that the charging roller 3 contacts with the pressing section 41. The datum straight line S is shown by a slid line connecting the axis 2*a* of the photoconductor 2 to a top of the photoconductor 2.

The charging roller 3, which contacts the pressing section 41 of the regulating member 4, is rotated in an arrow "B" direction (one direction) by following the rotation of the photoconductor 2. At that time, the charging roller 3 is pressed against the photoconductor 2 in an arrow "C" direction because of inclination of the pressing section 41. Thereby, the charging roller 3 is deformed into a generally elliptical shape cross-sectionally to contact the photoconductor 2 and charges the photoconductor 2.

When the photoconductor 2 stops rotating, the charging roller 3 also stops rotating. Then, pressing force caused by the pressing section 41 is vanished away, so that the charging roller 3 moves apart from the pressing section 41 to return to a free state. This prevents creep deformation. When the charging roller 3 is returned to the free state, next rotation of the photoconductor 2 leads to the aforementioned movement of the charging roller 3 wherever the charging roller 3 is positioned within the regulating member 4.

In addition to the foregoing shape, the regulating member 4 may have other shapes shown in FIG. 5A to FIG. 5D.

Figure 5A:
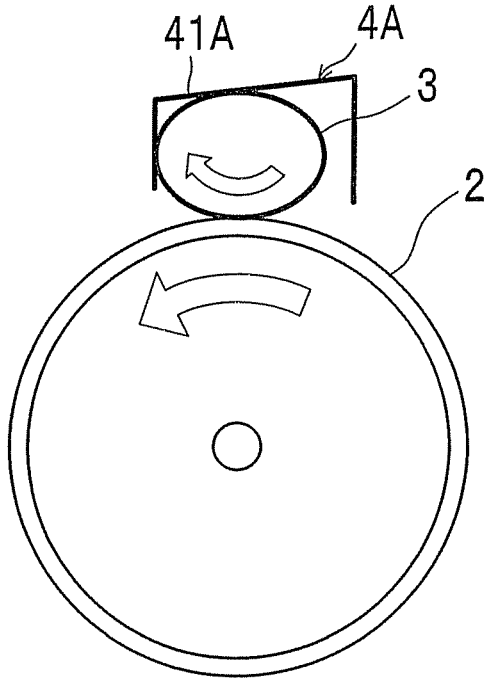
FIG. 5A shows a simplified structure view of a regulating member of the image forming unit having another configuration.

In FIG. 5A, a regulating member 4A has a generally boxy shape in cross section. Specifically, the regulating member 4A has front and back vertical walls and an upper wall inclining in the horizontal direction. The upper wall constitutes a pressing section 41A (similar to the pressing section 41). When the photoconductor 2 stops rotating, the charging roller 3 moves to a right side in the drawing to return to the free state. In other words, there is a space, where the charging roller 3 returns to the free state, on the right side of the regulating member 4A in the drawing.

Figure 5B:
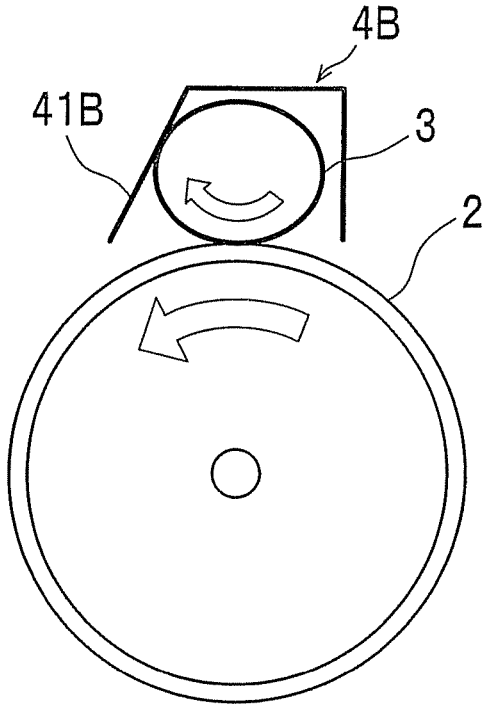
FIG. 5B shows a simplified structure view of the regulating member having still another configuration.

In FIG. 5B, a regulating member 4B has a generally boxy shape in cross section. Specifically, the regulating member 4B has front and back walls and an upper wall. The upper wall is inclined in the vertical direction so as to constitute a pressing section 41B (similar to the pressing section 41).

Figure 5C:
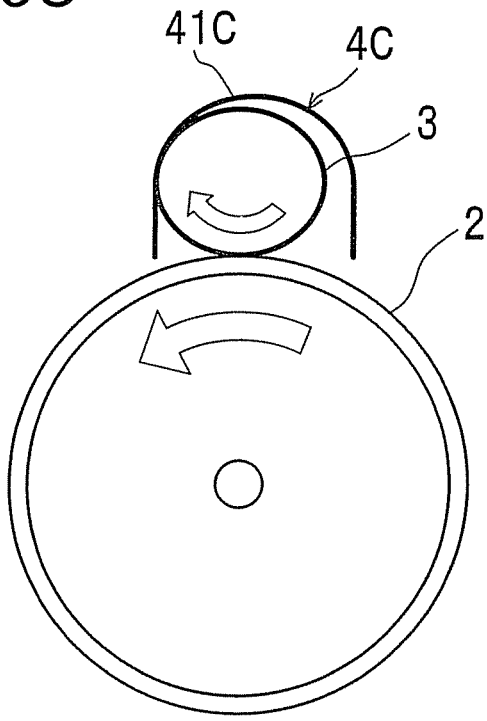
FIG. 5C shows a simplified structure view of the regulating member having yet another configuration.

In FIG. 5C, a regulating member 4C has a generally inverted U-shape in cross section. Specifically, the regulating member 4C has front and back walls and an upper wall. The upper wall is curved so as to constitute a pressing section 41C (similar to the pressing section 41). Since the pressing section 41C is curved, the charging roller 3 easily returns to the free state.

Figure 5D:
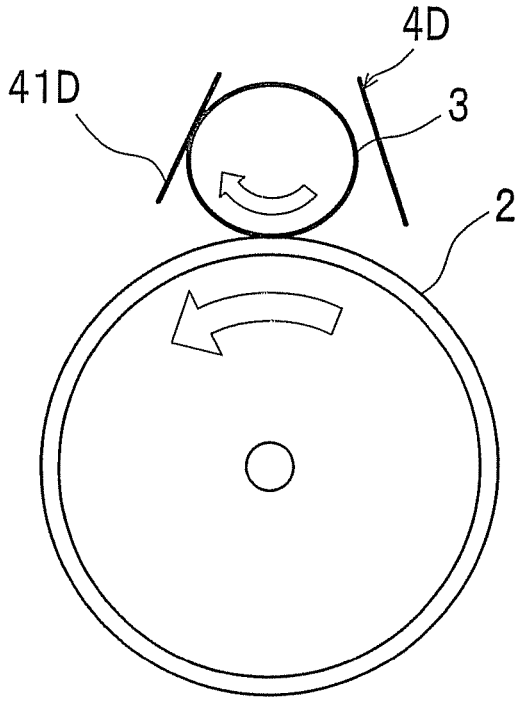
FIG. 5D shows a simplified structure view of the regulating member having still further another configuration.

In FIG. 5D, a regulating member 4D has a generally truncated chevron shape in cross section. Specifically, the regulating member 4D has front and back walls. The front wall is inclined in the vertical direction so as to constitute a pressing section 41D (similar to the pressing section 41).

According to the above-structured image forming unit, the pressing section 41 is inclined so as to be farther away from the photoconductor 2 toward the upstream of the one-way rotation of the photoconductor 2. In other words, the pressing section 41 together with the photoconductor 2 forms a wedge structure. As the photoconductor 2 rotates, the charging roller 3 goes into the wedge structure, and thereby the charging roller 3 is pressed toward the photoconductor 2. Thus, the charging roller 3 is brought into deformed pressure contact with the photoconductor 2. As the result, the charging roller 3 rotates at a generally constant speed, so that the charging roller 3 uniformly charges the photoconductor 2.

The charging roller 3 rotates following the rotation of the photoconductor 2. This makes it possible to prevent adhering substances, such as toners and toner post-processing agents, on the photoconductor 2 from accumulating on the contact portion between the photoconductor 2 and the charging roller 3. As a result, abnormal discharge can be suppressed.

Thus, the photoconductor 2 can be charged with a simplified structure and adhering substances can be prevented from accumulating on the contact portion between the photoconductor 2 and the charging roller 3.

The charging roller 3 is fitted in between the pressing section 41 and the photoconductor 2 by its own weight in the state that the charging roller 3 contacts with the pressing section 41. This is because the center 3*a* of the charging roller 3 is positioned within a central angle of 90 degrees from a datum straight line S to a horizontal line downstream of the one-way rotation of the photoconductor 2, as seen from the direction of axis 2*a* of the photoconductor 2.

The charging roller 3 is easily elastically-deformed since the charging roller 3 is a hollow roller.

The frictional resistance of the photoconductor 2 against the charging roller 3 is equal to or larger than the frictional resistance of the regulating member 4 against the charging roller 3. Therefore, the charging roller 3 can certainly be rotated following the rotation of the photoconductor 2, while the charging roller 3 can certainly be pushed in between the pressing section 41 and the photoconductor 2.

A slide member is provided in a portion of the regulating member 4 which contacts with the charging roller 3. Therefore, the frictional resistance of the regulating member 4 against the charging roller 3 can be made smaller than the frictional resistance of the photoconductor 2 against the charging roller 3. Therefore, the charging roller 3 can certainly be rotated following the rotation of the photoconductor 2, while the charging roller 3 can certainly be pushed in between the pressing section 41 and the photoconductor 2.

The regulating member 4 has such a size as to house the charging roller 3 in the free state. This makes it possible to prevent the charging roller 3 from having any harmful habitual tendency.

The image forming apparatus has the above-structured image forming unit 1 which can simplify structure thereof and can enhance quality in image.

Second Embodiment

Figure 6A:
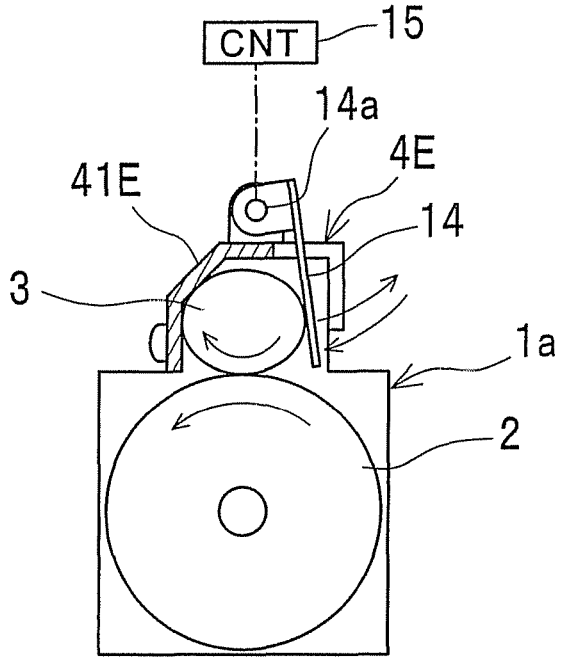
FIG. 6A shows a simplified schematic view of an image forming unit according to a second embodiment of the invention.
Figure 6B:
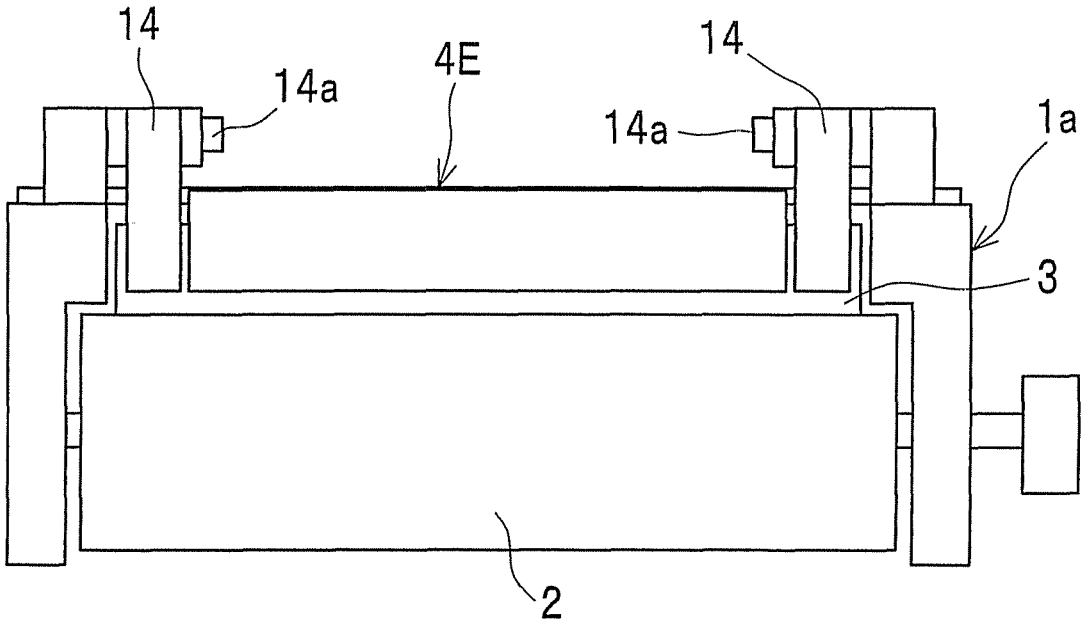
FIG. 6B shows a rear view of the image forming unit.

An image forming unit in a second embodiment of the invention, as shown in FIGS. 6A and 6B, is different from that of the first embodiment in the structure of the pressing member. In the second embodiment, component members identical to those in the first embodiment are designated by identical reference numerals to omit explanation.

A pressing member 14 presses the charging roller 3 against at least the photoconductor 2 or both the pressing section 41 E of the regulating member 4E and the photoconductor 2. That is to say, the pressing member 14 presses the charging roller 3 against both a pressing section 41 E of a regulating member 4E and the photoconductor 2, as shown in FIG. 6A, or only the photoconductor 2.

The pressing member 14 is placed on both ends of the charging roller 3 in the axial direction thereof, as shown in FIG. 6B. The pressing member 14 is provided with a shaft section 14*a* attached to the casing 1*a*. The pressing section 41E contacts the charging roller 3 from the rear side. The pressing member 14 swings around the shaft section 14*a*, so that pressing member 14 comes close to or goes away from the charging roller 3. The pressing member 14 contacts an end of the charging roller 3, which end is positioned outside of the image forming region of the charging roller 3.

The pressing member 14 is electrically connected to a control section 15. The control section 15 includes a solenoid, for example. At the start of image formation, the control section 15 moves the pressing member 14 toward the charging roller 3 so that the charging roller 3 can follow the rotation of the photoconductor 2. At the end of image formation, the control section 15 moves the pressing member 14 away from the charging roller 3 so that the charging roller 3 may return to the free state. Electric current to the charging roller 3 is conducted by at least one of the regulating member 4E and the pressing member 14.

The image forming unit has the pressing member 14 which presses the charging roller 3 against the photoconductor 2, and the charging roller 3 can fit in between the pressing section 41E and the photoconductor 2 by using the pressing member 14.

The image forming unit is provided with the control section 15 which moves the pressing member 14 in the direction away from the charging roller 3 at the end of image formation. Thereby, the charging roller 3 can return to the free state, which makes it possible to prevent the charging roller 3 from having any harmful habitual tendency.

Third Embodiment

An image forming unit in a third embodiment of the invention, as shown in FIG. 7, is different from that of the second embodiment in the position of the charging roller. In the third embodiment, component members identical to those in the second embodiment are designated by identical reference numerals to omit explanation.

Figure 7A:
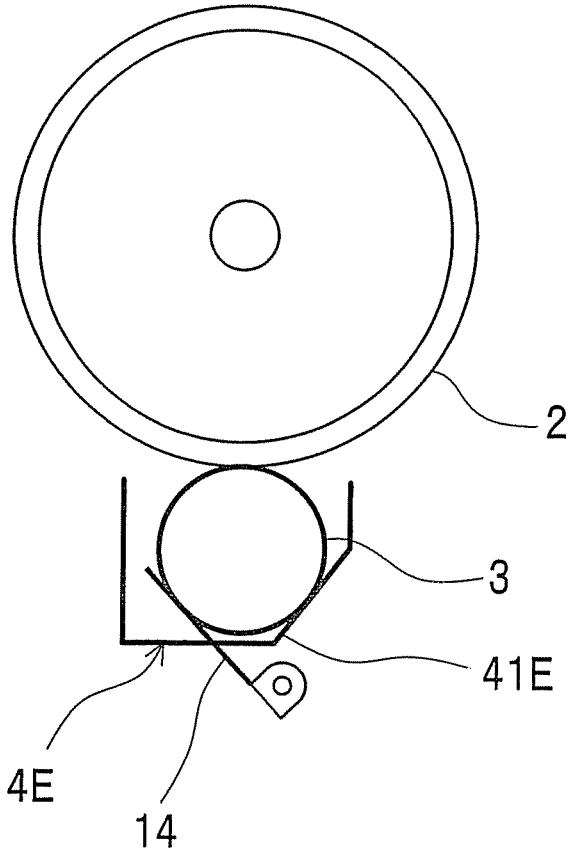
FIG. 7A shows a simplified schematic view of an image forming unit according to a third embodiment of the invention.

As shown in FIG. 7A, the charging roller 3, the regulating member 4E, and the pressing member 14 are positioned below the photoconductor 2. The pressing member 14 presses the charging roller 3 against at least the photoconductor 2 or both the pressing section 41 E of the regulating member 4E and the photoconductor 2.

Description is now given on the movement of the charging roller 3.

Figure 7B:
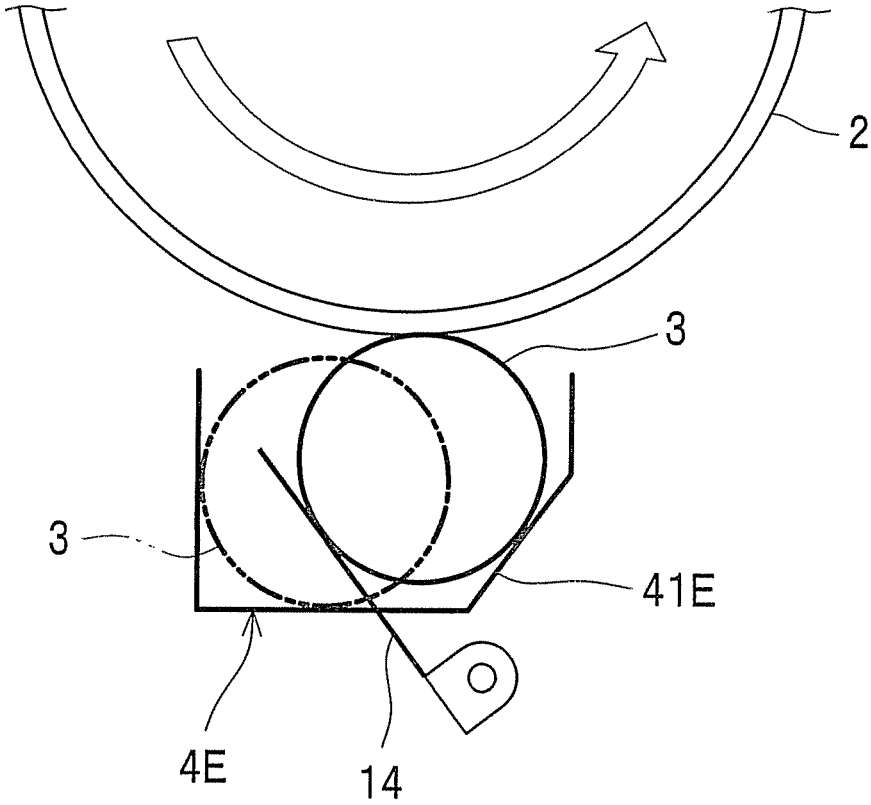
FIG. 7B shows a view for explaining the operation of the image forming unit.

As shown in FIG. 7B, the charging roller 3 is moved by the pressing member 14 from the state shown by an imaginary line to the state by a solid line. Thereby, the charging roller 3 comes into light contact with both the photoconductor 2 and the regulating member 4E.

The charging roller 3 rotates following the rotation of the photoconductor 2. At this point, the charging roller 3 is pressed against the photoconductor 2 by the inclined pressing section 41E. The charging roller 3 contacts the photoconductor 2 to charge the photoconductor 2 while the charging roller 3 is elastically being deformed.

Thereafter, when the rotation of the photoconductor 2 stops, the charging roller 3 also stops rotating. At that time, the pressing forces by both the pressing section 41E and the pressing member 14 are vanished away. Consequently, the charging roller 3 returns to the free state, which can prevent creep deformation.

Figure 8:
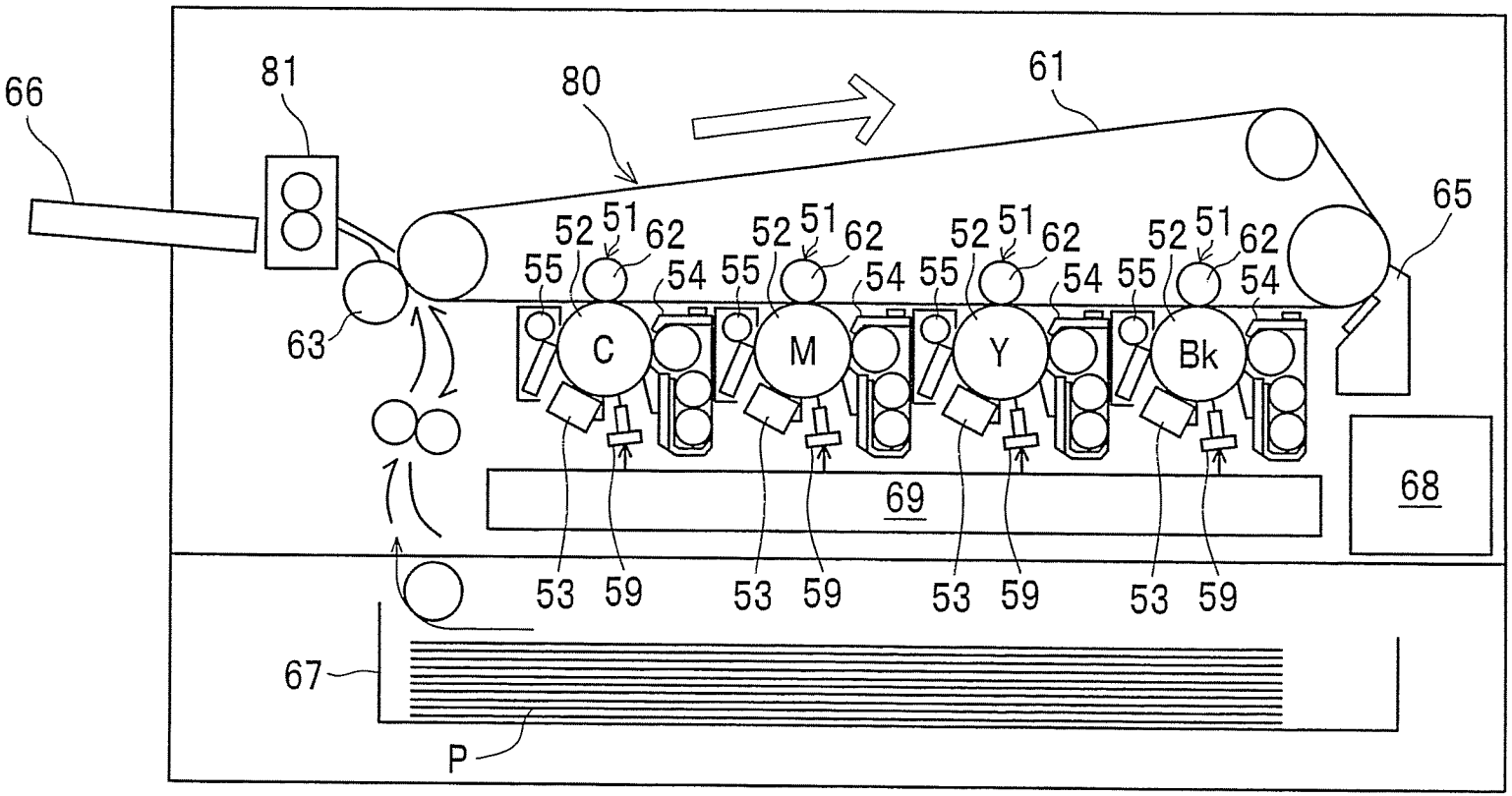
FIG. 8 shows a simplified schematic view of an image forming apparatus of the invention.

FIG. 8 shows an image forming apparatus having the image forming unit in the third embodiment. The image forming apparatus is a four-color electrophotographic printer. The image forming apparatus is provided with an imaging device 80 and a fixing device 81. The imaging device 80 attaches unfixed toner to recording material P so as to form images. The fixing device 81 melts the toner to fix it to the recording material.

The imaging device 80 is provided with an intermediate transfer belt 61, four image forming units 51, a primarily transfer section 62, and a secondary transfer section 63. The image forming units 51 are placed along the intermediate transfer belt 61 for forming toner images. The primarily transfer section 62 transfers the toner images onto the intermediate transfer belt 61, which images have been formed by each of the image forming units 51. The secondary transfer section 63 transfers the images onto recording material P, which images have been transferred onto the intermediate transfer belt 61.

An image forming unit 51 for forming toner images in black (BK), an image forming unit 51 for forming toner images in yellow (Y), an image forming unit 51 for forming toner images in magenta (M), and an image forming unit 51 for forming toner images in cyan (C) are placed in this order along from the upstream to the downstream of the intermediate transfer belt 61.

The image forming unit 51 has a photoconductor 52, a charging roller 53, an exposure device 59, and a developing section 54. The charging roller 53 uniformly charges the photoconductor 52. The exposure device 59 performs image exposure of the charged photoconductor 52. The developing section 54 develops an electrostatic latent image formed by the exposure with each color toner.

The image forming apparatus is provided with a control device 68 an exposure control device 69. The control device 68 controls the entire image forming apparatus. The exposure control device 69 receives signals sent from the control device 68 corresponding to images. The exposure control device 69 drives each of the exposure sections 59 according to respective colors.

Description is now given on the function of the image forming apparatus.

A toner image is developed on the photoconductor 52 in the image forming unit 51. The toner image is primarily transferred onto the intermediate transfer belt 61 by the primary transfer section 62 at a position contacted with the intermediate transfer belt 61.

Whenever the intermediate transfer belt 61 passes through each of the image forming units 51, a toner image having each of colors is laid on top thereof to be transferred on the intermediate transfer belt 61. Finally, a full color toner image is formed on the intermediate transfer belt 61.

Then, the full color toner image on the intermediate transfer belt 61 is secondarily transferred onto a recording material P in the downstream of the intermediate transfer belt 61 by the secondary transfer section 63.

The recording material P then passes through the fixing device 81, which is located in the downstream of a conveying path of the recording material P, so that the toner image is fixed on the he recording material P. Then, the recording material P is discharged onto a paper output tray 66.

The recording material S is stored in a lowermost cassette 67. The recording material S is conveyed one by one from the cassette 67 to the secondary transfer section 63.

After the primary transfer, the toner remaining on the photoconductor 52 is removed by a cleaning section 55 placed downstream, and is thereafter collected from the lower side of the cleaning section 55.

After secondary transfer, the toner remaining on the intermediate transfer belt 61 is removed from the surface of the intermediate transfer belt 61 by a cleaning blade 65. Thereafter, the toner is conveyed by an unshown conveyance screw, and then collected in an unshown waste toner bottle.

Fourth Embodiment

Figure 9A:
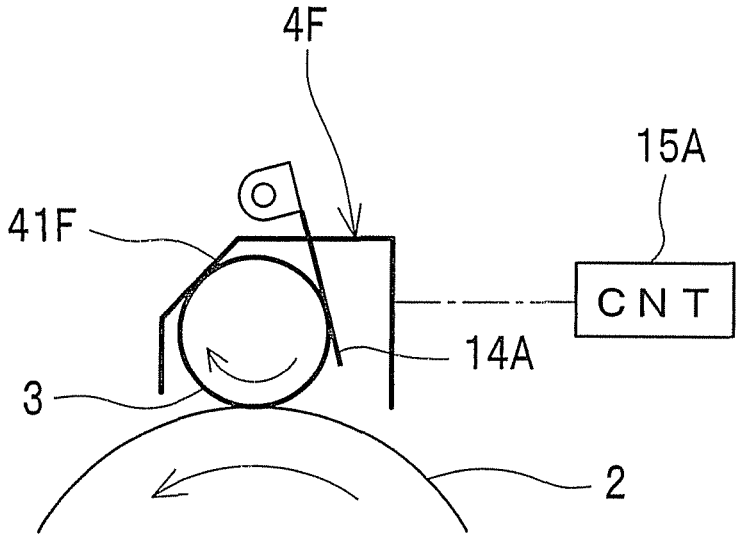
FIG. 9A shows a simplified schematic view of an image forming unit according to a fourth embodiment of the invention.
Figure 9B:
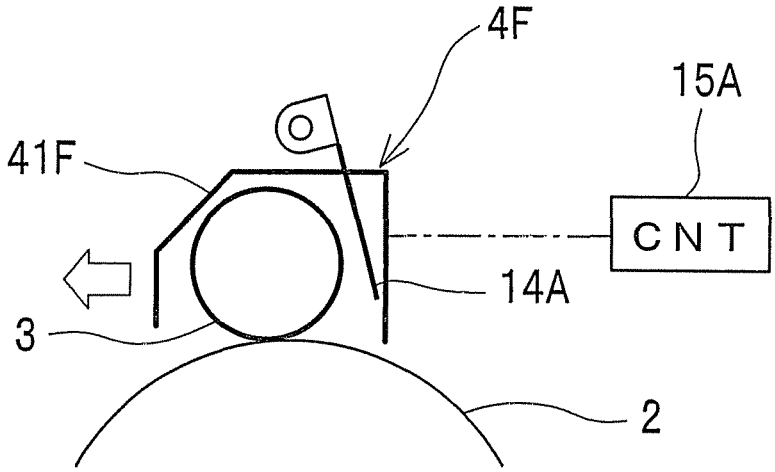
FIG. 9B shows a view for explaining the operation of the image forming unit.

An image forming unit in a fourth embodiment of the invention, as shown in FIG. 9A and FIG. 9B, is different from that of the second embodiment in the structure of returning the charging roller to the free state. In the fourth embodiment, component members identical to those in the second embodiment are designated by identical reference numerals to omit explanation.

As shown in FIG. 9A, a shaft section of a pressing member 14A is fixed to a casing so that the pressing member 14A may not move relatively to the photoconductor 2. The pressing member 14A presses the charging roller 3 against at least the photoconductor 2 or both a pressing section 41 F of a regulating member 4F and the photoconductor 2.

A control section 15A is electrically connected to the regulating member 4F. As shown in FIG. 9B, the control section 15A moves the regulating member 4F in the direction away from the charging roller 3 so that the charging roller 3 may return to the free state at the end of image formation. Therefore, it becomes possible to prevent the charging roller 3 from having any harmful habitual tendency.

Fifth Embodiment

Figure 10A:
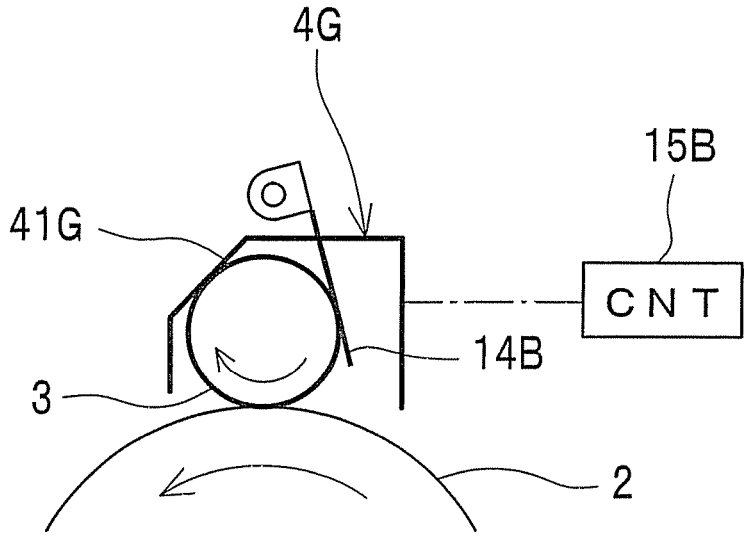
FIG. 10A shows a simplified schematic view of an image forming unit according to a fifth embodiment of the invention.
Figure 10B:
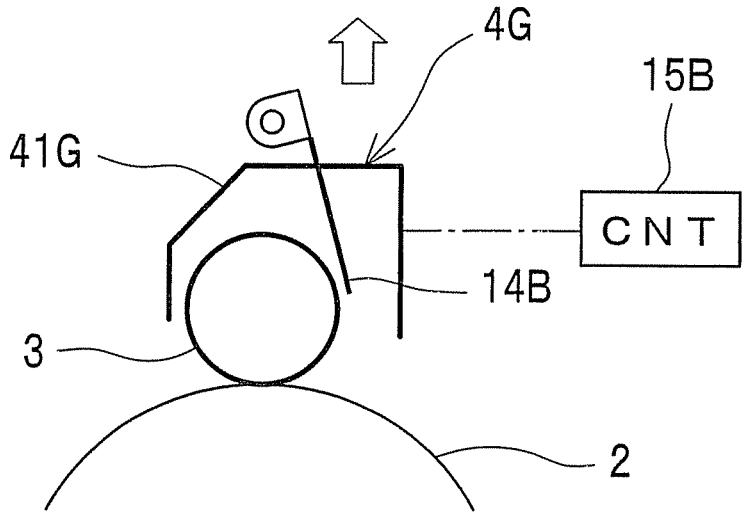
FIG. 10B shows a view for explaining the operation of the image forming unit.

An image forming unit in a fifth embodiment of the invention, as shown in FIG. 10A and FIG. 10B, is different from that of the second embodiment in mechanism for returning the charging roller to the free state. In the fifth embodiment, component members identical to those in the second embodiment are designated by identical reference numerals to omit explanation.

As shown in FIG. 10A, a pressing member 14B is attached to a regulating member 4G. The pressing member 14B presses the charging roller 3 against at least the photoconductor 2 or both a pressing section 41 G of the regulating member 4G and the photoconductor 2.

A control section 15B is electrically connected to the regulating member 4G. As shown in FIG. 10B, the control section 15B moves the regulating member 4G together with the pressing member 14B in the direction away from the photoconductor 2 so that the charging roller 3 may return to the free state at the end of image formation. Therefore, it becomes possible to prevent the charging roller 3 from having any harmful habitual tendency.

Sixth Embodiment

Figure 11A:
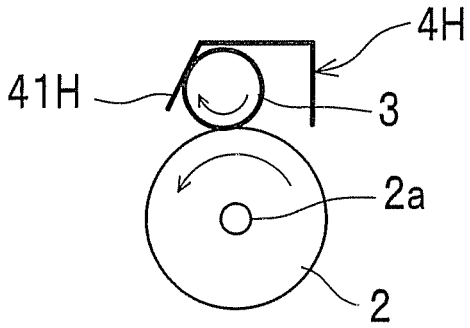
FIG. 11A shows a simplified schematic view of an image forming unit according to a sixth embodiment of the invention.
Figure 11B:
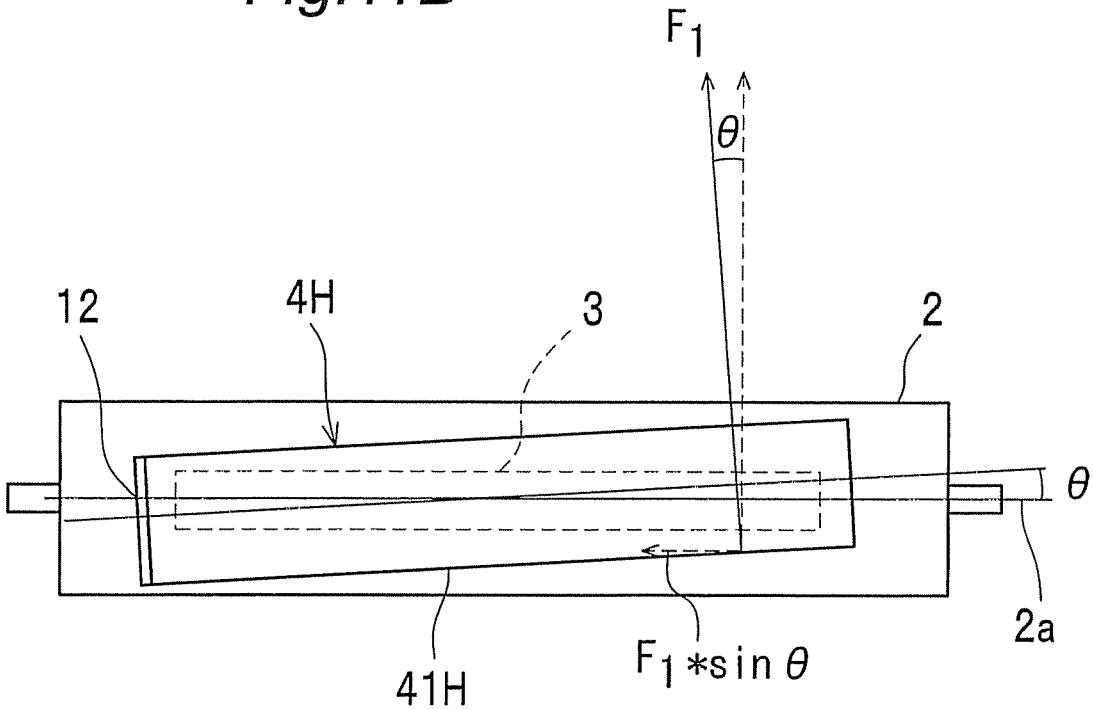
FIG. 11B shows a plan view of the image forming unit.

An image forming unit in a sixth embodiment of the invention, as shown in FIG. 11A and FIG. 11B, is different from that of the first embodiment in the position of the regulating member. In the sixth embodiment, component members identical to those in the first embodiment are designated by identical reference numerals to omit explanation.

As shown in FIG. 11A, a regulating member 4H has a contact surface which contacts with the charging roller 3 during one-way (arrow direction) rotation of the photoconductor 2 and the charging roller 3. The plane including the contact surface intersects the axis 2*a* of the photoconductor 2.

Specifically, the contact surface is formed on the pressing section 41H of the regulating member 4H, and, as shown in FIG. 11B, is inclined with respect to the axis 2*a* of the photoconductor 2 by an angle of θ, when seen from the above. Thus, the plane including the contact surface intersects the axis 2*a* of the photoconductor 2.

When the photoconductor 2 rotates in the arrow direction shown in FIG. 11A, the charging roller 3 rotates while contacting with the contact surface of the pressing section 41H. At this time, the charging roller 3 receives force $F_1$ from the contact surface, as shown in FIG. 11B. Since the contact surface is inclined by an angle θ, the charging roller 3 receives F1×sin θ (F1 multiplied by sin θ) as a force parallel to the axis 2*a* of the photoconductor 2. This force moves the charging roller 3 leftward to the position where an end of the charging roller 3 reaches a stopper section 12 of the regulating member 4H. Naturally, the charging roller 3 is pressed against the photoconductor 2 by the pressing section 41H.

Figure 12:
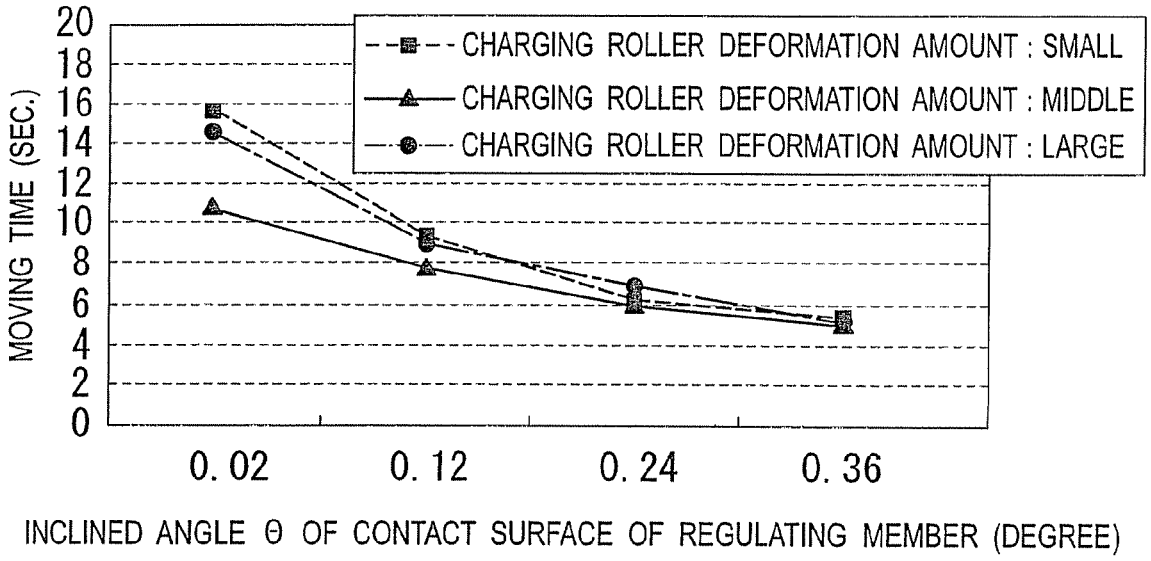
FIG. 12 shows a graph view of relation between an inclined angle θ of a contact surface of the regulating member and a moving time of a charging roller.

FIG. 12 shows relation between the inclined angle θ of the contact surface of the regulating member 4H and moving time of the charging roller 3. In FIG. 12, the moving amount of the charging roller 3 is fixed, and the rotational speed of the photoconductor 2 is constant.

As shown in FIG. 12, the larger the inclined angle θ becomes, the faster the charging roller 3 moves. The moving velocity of the charging roller 3 also depends on the deformation amount of the charging roller 3. The medium deformation amount makes the charging roller 3 move fastest. As the inclined angle θ becomes larger, however, the influence of the deformation amount of the charging roller 3 is decreased.

As stated above, the moving velocity of the charging roller 3 in the longitudinal direction increases as the inclined angle θ becomes larger. However, it should be noted that the larger angle may exert a bad influence on charging performance, and therefore the inclined angle θ is not over one degree, preferably.

According to the above-structured image forming unit, the contact surface is not parallel but inclined with respect to the axis 2*a* of the photoconductor 2. This makes it possible to move the charging roller 3 to one side in the longitudinal direction thereof when the photoconductor 2 is rotated. Accordingly, the charging roller 3 reaches the stopper section 12, so that the longitudinal position of the charging roller 3 can be stabilized.

In contrast, if the contact surface is made parallel to the center (i.e. axis) of the charging roller 3, the longitudinal position of the charging roller 3 becomes unstable because the charging roller 3 minutely vibrates or zigzags in the longitudinal direction thereof. This has required an additionally larger size of the charging roller 3 in the longitudinal direction so as to uniformly charge the photoconductor 2 even when the charging roller 3 reciprocates in the longitudinal direction.

Seventh Embodiment

Figure 13A:
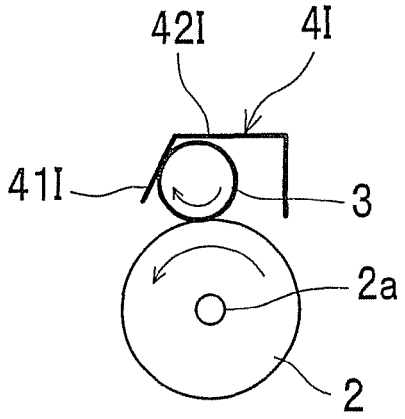
FIG. 13A shows a simplified schematic view of an image forming unit according to a seventh embodiment of the invention.
Figure 13B:
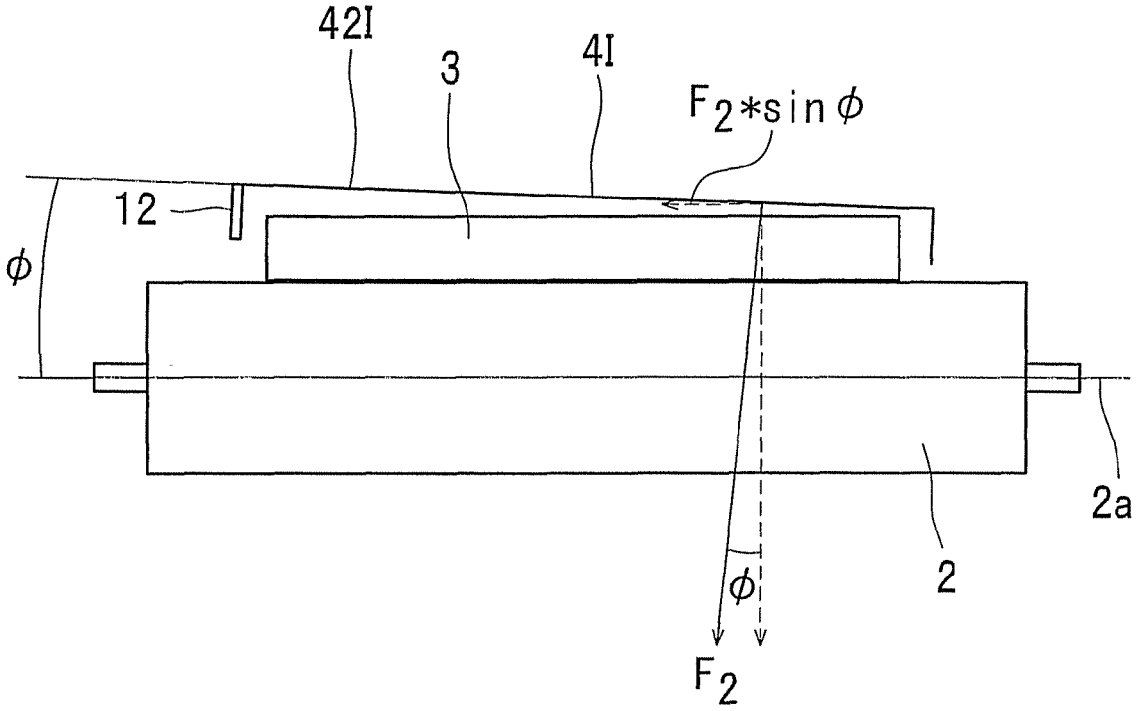
FIG. 13B shows a front view of the image forming unit.

An image forming unit in a seventh embodiment of the invention, as shown in FIG. 13A and FIG. 13B, is different from that of the first embodiment in the position of the regulating member. In the seventh embodiment, component members identical to those in the first embodiment are designated by identical reference numerals to omit explanation.

As shown in FIG. 13A, a regulating member 4I has a contact surface which contacts with the charging roller 3 during one-way (arrow direction) rotation of the photoconductor 2 and the charging roller 3. The plane including the contact surface intersects the axis 2*a* of the photoconductor 2.

Specifically, the contact surface is formed on an upper wall 42I of the regulating member 4I, and, as shown in FIG. 13B, is inclined with respect to the axis 2*a* of the photoconductor 2 by an angle of Φ, when seen from the front.

When the photoconductor 2 rotates in the arrow direction shown in FIG. 13A, the charging roller 3 rotates while contacting the contact surface of the upper wall 42I. At this time, the charging roller 3 receives force $F_2$ from the contact surface, as shown in FIG. 13B. Since the contact surface is inclined by an angle Φ, the charging roller 3 receives $F_2 \times \sin \Phi$ as a force parallel to the axis 2*a* of the photoconductor 2. The force moves the charging roller 3 leftward to the position where an end section of the charging roller 3 reaches a stopper section 12 of the regulating member 4I. Naturally, the charging roller 3 is pressed against the photoconductor 2 by the pressing section 41I of the regulating member 4I.

Figure 14:
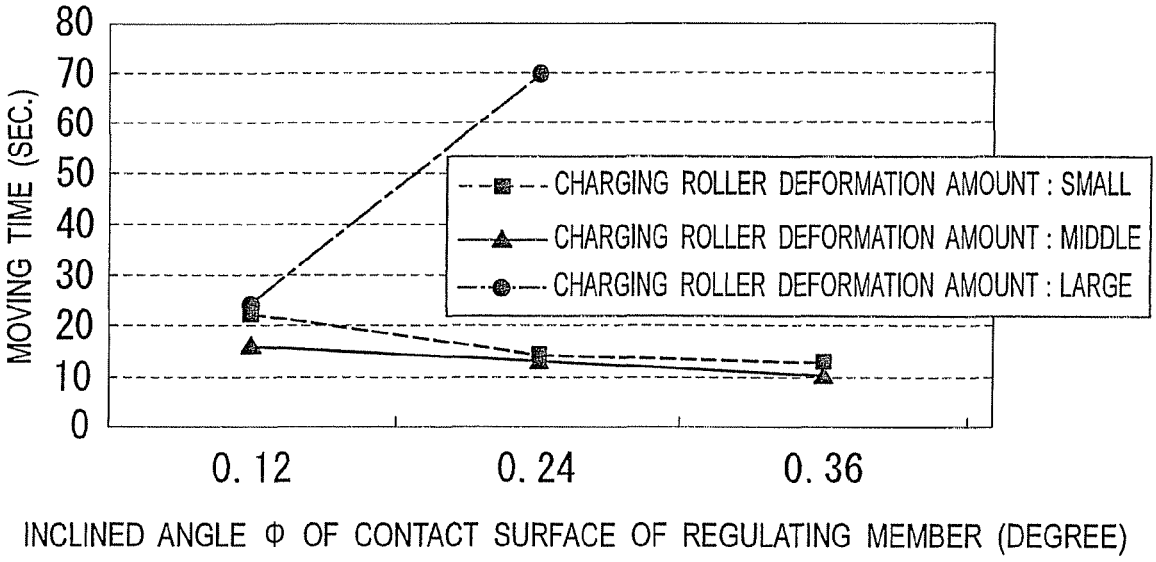
FIG. 14 shows another graph view of relation between the inclined angle ϕ of the contact surface of the regulating member and the moving time of the charging roller.

FIG. 14 shows the relation between the inclined angle Φ of the contact surface of the regulating member 4I and the moving time of the charging roller 3. In FIG. 14, the moving amount of the charging roller 3 is fixed, and the rotational speed of the photoconductor 2 is constant.

As shown in FIG. 14, in the case where the deformation amount of the charging roller 3, which deformation is caused by the regulating member 4I, is small and middle, the larger the inclined angle Φ becomes, the faster the charging roller 3 moves. As the inclined angle Φ becomes larger, the deformation amount of the charging roller 3 less influences the movement of the charging roller 3.

In the case where the deformation amount of the charging roller 3 is large, the charging roller 3 does not display the desired behavior. The deformation amounts of the charging roller 3 are obtained at the position where the charging roller 3 has reached a stopper section 12 as shown in the left side of FIG. 13B. Accordingly, the deformation amounts are increased toward the right side of the charging roller 3 due to the inclination of the regulating member 4I. Therefore, in the case where the deformation amount is large as shown in FIG. 14, the deformation amount on the right side of the charging roller 3 becomes much larger excessively.

The moving velocity of the charging roller 3 in the longitudinal direction increases as the inclined angle Φ becomes larger. However, the larger inclined angle may exert a bad influence on charging performance and the like. It is preferable that the inclined angle is 1 degree or less.

According to the above-structured image forming unit, the contact surface is not parallel but inclined with respect to the axis 2*a* of the photoconductor 2. This makes it possible to move the charging roller 3 on one side in the longitudinal direction thereof when the photoconductor 2 rotates. Accordingly, the charging roller 3 reaches the stopper section 12, so that the longitudinal position of the charging roller 3 can be stabilized.

In contrast, if the contact surface is made parallel to the axis of the charging roller 3, the longitudinal position of the charging roller 3 becomes unstable because the charging roller 3 minutely vibrates or zigzags in the longitudinal direction thereof. This has required an additionally larger size of the charging roller 3 in the longitudinal direction so as to uniformly charge the photoconductor 2 even when the charging roller 3 reciprocates in the longitudinal direction.

Eighth Embodiment

Figure 15:
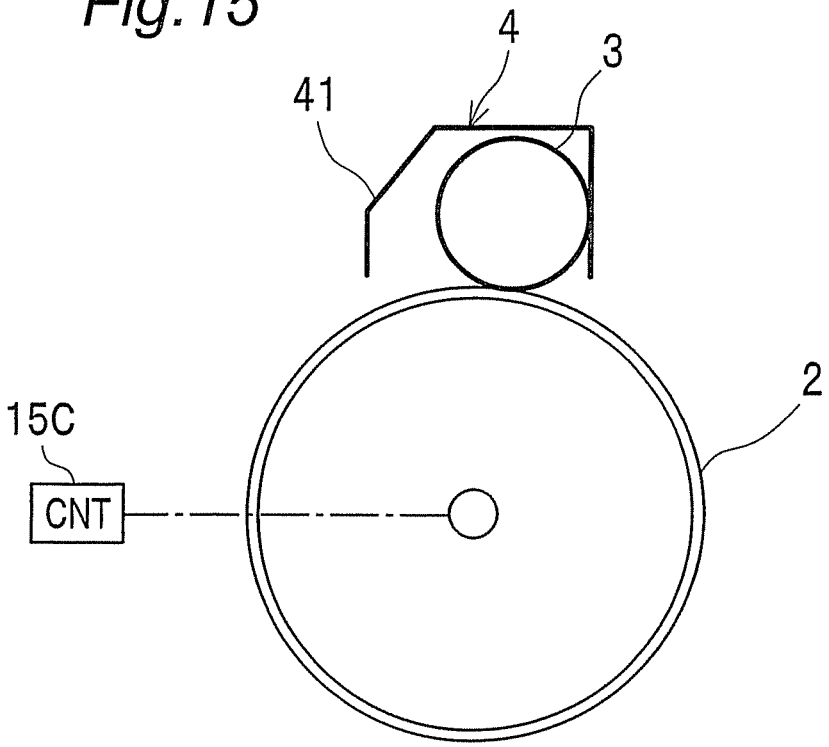
FIG. 15 shows a simplified schematic view of an image forming unit according to an eighth embodiment of the invention.

An image forming unit in an eighth embodiment of the invention, as shown in FIG. 15, is different from that of the first embodiment in the structure of the control section. In the eighth embodiment, component members identical to those in the first embodiment are designated by identical reference numerals to omit explanation.

As shown in FIG. 15, a control section 15C is connected to the photoconductor 2. The control section 15C rotates the photoconductor 2 in the other direction (opposite direction) at the end of image formation.

Description is now given on the operation of the charging roller 3.

Figure 16A:
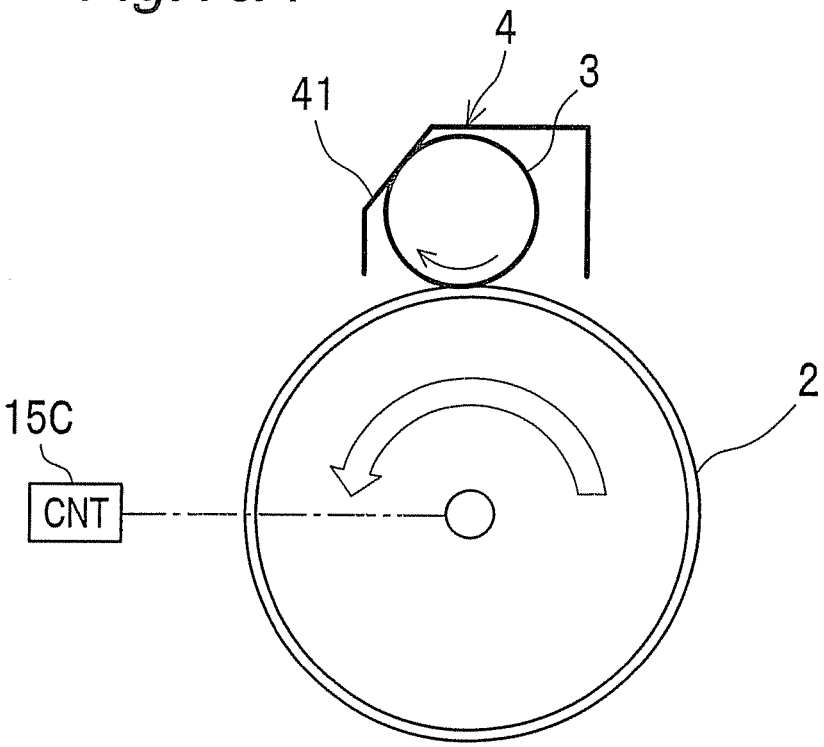
FIG. 16A shows a view for explaining the operation of the image forming unit.

As shown in FIG. 16A, when the photoconductor 2 starts rotating in an arrow direction (counterclockwise), the frictional force between the photoconductor 2 and the charging roller 3 moves the charging roller 3 leftward to the position where the charging roller 3 is regulated by the regulating member 4.

Figure 16B:
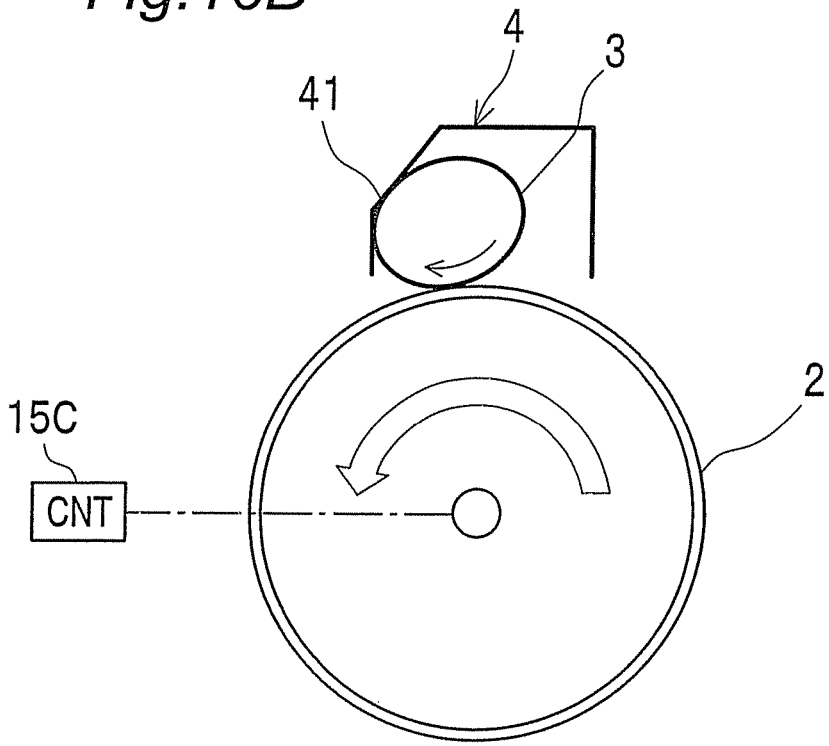
FIG. 16B shows another view for explaining the operation of the image forming unit.

Then, as shown in FIG. 16B, the charging roller 3 continues to rotate in the well force-balanced state (shape) where the frictional force between the photoconductor 2 and the regulating member 4, forces derived from the shape and physical properties of the charging roller 3 and the like are well balanced.

When the photoconductor 2 stops, the charging roller 3 stops in the state that the charging roller 3 is elastically deformed in some cases. If this state continues for a long time, the charging roller 3 suffers creep deformation. The deformation of the charging roller 3 may make unstable the rotational speed of the charging roller 3 and the contact position between the photoconductor 2 and the charging roller 3. This may cause uneven charging not to obtain good images.

Figure 16C:
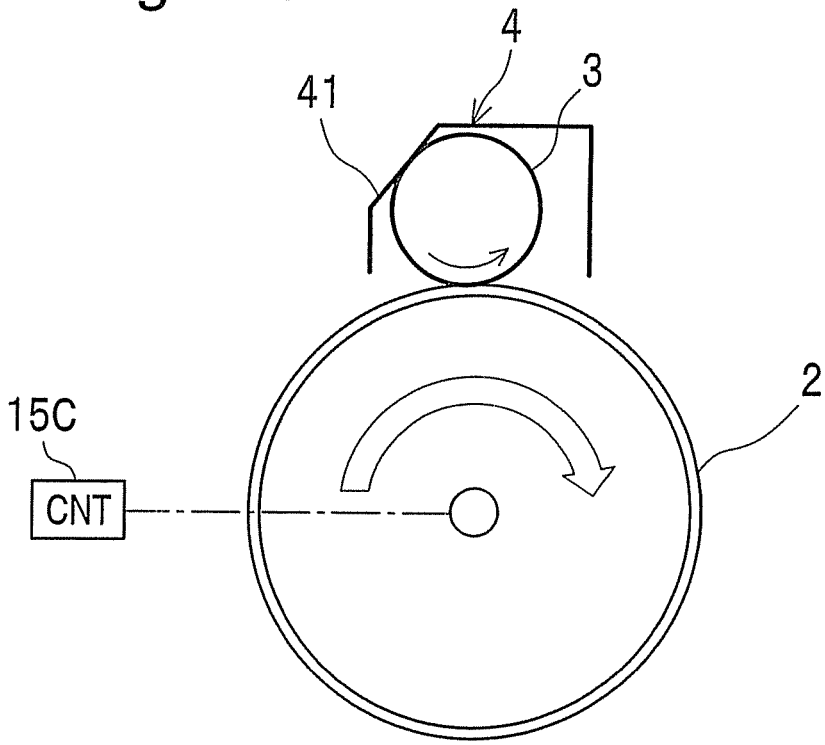
FIG. 16C shows still another view for explaining the operation of the image forming unit.

As shown in a FIG. 16C, therefore, the photoconductor 2 is rotated reversely (clockwise in the figure) for a fixed amount of rotation when the photoconductor 2 stops. This surely returns the charging roller 3 to the free state and then brings the charging roller 3 in the state shown in FIG. 15.

In the above-structured image forming unit, the photoconductor 2 is inversely rotated by the control section 15C at the end of image formation. Therefore, the charging roller 3 can certainly be returned to the free state at the end of image formation, which prevents the charging roller 3 from having any harmful habitual tendency.

Ninth Embodiment

Figure 17A:
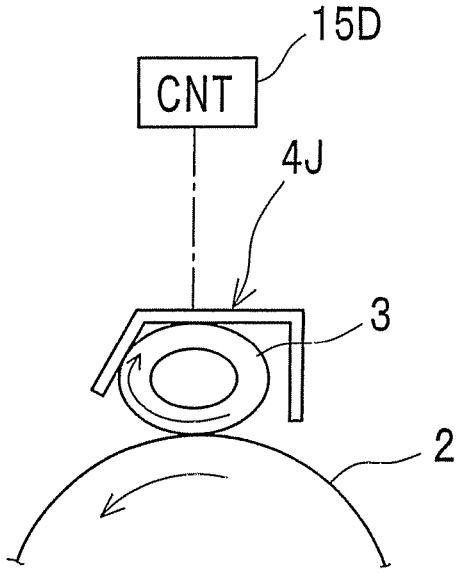
FIG. 17A shows a simplified schematic view of an image forming unit according to a ninth embodiment of the invention.

An image forming unit in a ninth embodiment of the invention, as shown in FIG. 17A, is different from that of the first embodiment in the point that the charging roller is pressed by an upper wall of the regulating member. In the ninth embodiment, component members identical to those in the first embodiment are designated by identical reference numerals to omit explanation.

Figure 17B:
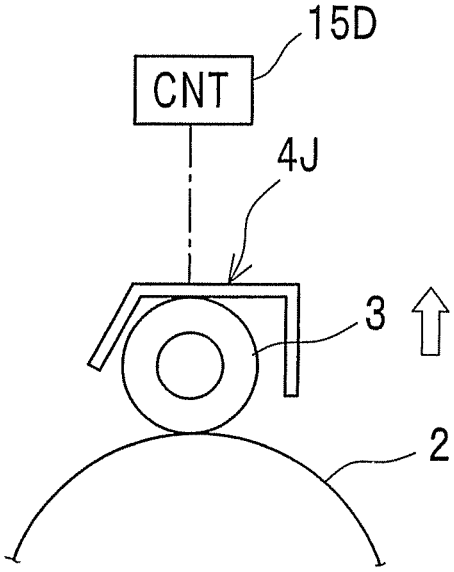
FIG. 17B shows a view for explaining the operation of the image forming unit.

As shown in FIG. 17A, a control section 15D is electrically connected to a regulating member 4J. During charging operation, the charging roller 3 is pressed against the photoconductor 2 with the upper wall of the regulating member 4J by using the control section 15D so as to maintain the contact state between the charging roller 3 and the photoconductor 2. At the end of image formation, as shown in FIG. 17B, the regulating member 4J is moved upward by the control section 15D so as to be separated from the charging roller 3 so that the charging roller 3 may return to the free state. This prevents the charging roller 3 from having any harmful habitual tendency.

Figure 18:
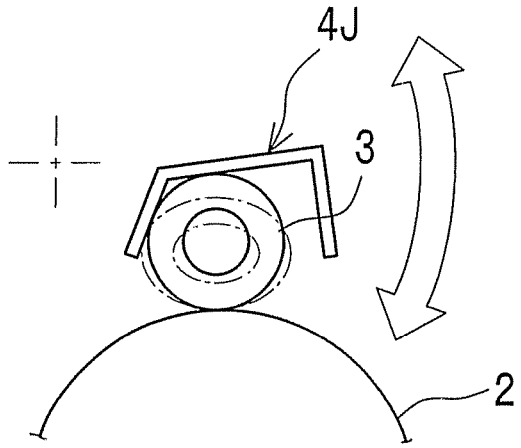
FIG. 18 shows a view for explaining the operation of an image forming unit having another configuration.
Figure 19:
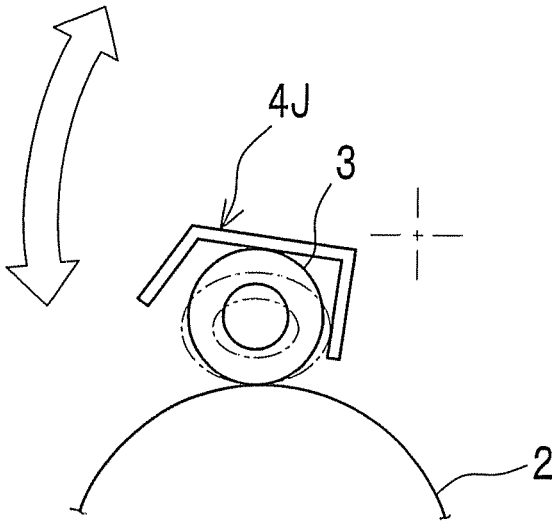
FIG. 19 shows a view for explaining the operation of an image forming unit having still another configuration.

The regulating member 4J may be swung centering on the front side (left side in the drawing) of the regulating member 4J, as shown in FIG. 18 The regulating member 4J may be swung centering on the back side (right side in the drawing) of the regulating member 4J, as shown in FIG. 19.

Description is now given on the control timing of the rotation of the photoconductor 2 and the position of the regulating member 4J by the control section 15D.

Figure 20:
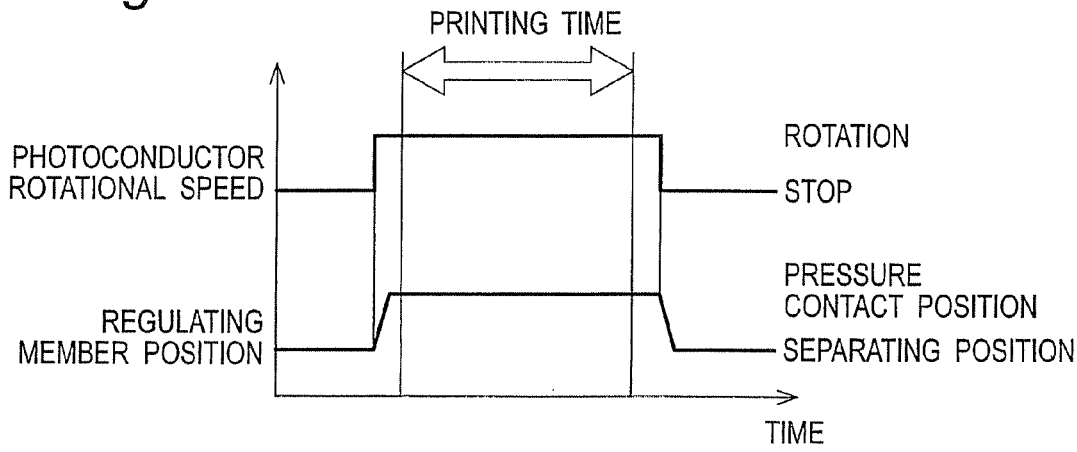
FIG. 20 shows a graph view of control timing by a control section regarding the rotation of the photoconductor and the position of the regulating member.

At the start of image formation, as shown in FIG. 20, the regulating member 4J is moved in the direction closer to the charging roller 3 so as to be placed at a pressure contact position, and simultaneously rotation of the photoconductor 2 is started. Next, image formation (printing) is performed. At the end of image formation, rotation of the photoconductor 2 is stopped, and simultaneously the regulating member 4J is moved in the direction away from the charging roller 3 so as to be placed at a separating position.

Figure 21:
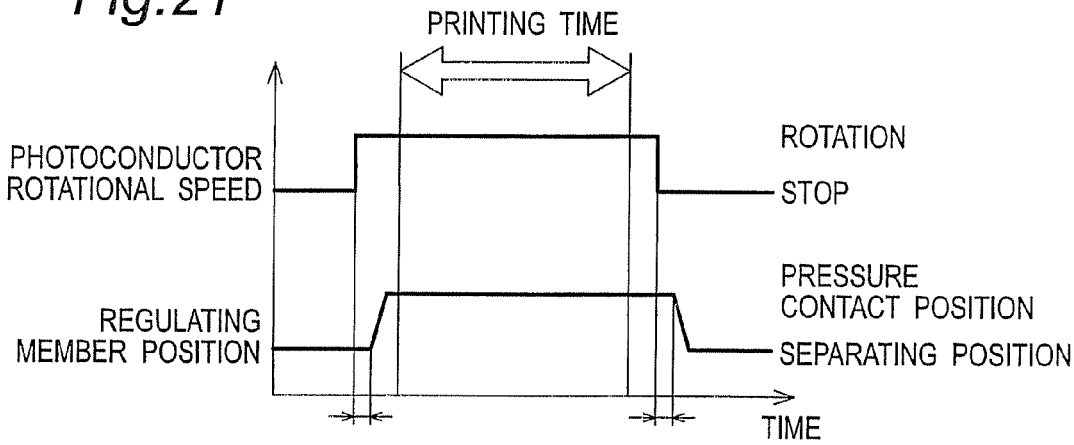
FIG. 21 shows a graph view of another control timing by the control section regarding the rotation of the photoconductor and the position of the regulating member.

Another control timing by the control section 15D may be employed. As shown in FIG. 21, at the start of image formation, rotation of the photoconductor 2 is started. After prescribed time elapses, the regulating member 4J is moved in the direction closer to the charging roller 3 so as to be placed at the pressure contact position. Next, image formation (printing) is performed. At the end of image formation, rotation of the photoconductor 2 is stopped. After prescribed time elapses, the regulating member 4J is moved in the direction away from the charging roller 3 so as to be placed at the separating position. This control timing makes it possible to reliably prevent the charging roller 3 from having any harmful habitual tendency at the end of image formation.

Figure 22:
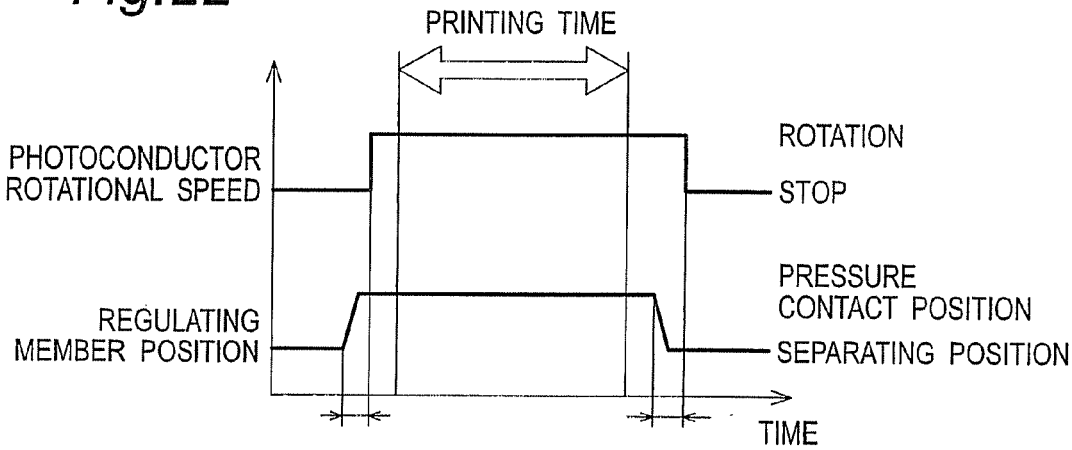
FIG. 22 shows a graph view of still another control timing by the control section regarding the rotation of the photoconductor and the position of the regulating member.

Still another control timing may be employed by using the control section 15D. As shown in FIG. 22, at the start of image formation, the regulating member 4J is moved in the direction closer to the charging roller 3. After prescribed time elapses, rotation of the photoconductor 2 is started. Next, image formation (printing) is performed. At the end of image formation, the regulating member 4J is moved in the direction away from the charging roller 3. After prescribed time elapses, rotation of the photoconductor 2 is stopped. This control timing makes it possible to prevent the charging roller 3 from charging the photoconductor 2 in a deformed state of the charging roller 3 at the start of image formation.

The present invention shall not be limited to the above-disclosed embodiments. For example, the technical features of the first to ninth embodiments may be combined freely. The image forming units of the second and the fourth through ninth embodiments may be applied to the image forming apparatus of the first embodiment. The image forming apparatus may be any apparatus including monochrome/color copying machines, printers, facsimiles, and multi-functional machines.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. An image forming unit, comprising:

a rotatable photoconductor;

an elastically deformable charging roller for charging the photoconductor, which roller contacts with an outer face of the photoconductor and rotates following rotation of the photoconductor;

a regulating member for regulating movement of the charging roller, which member is placed so as to surround the charging roller, the regulating member having a pressing section which contacts with the charging roller in a longitudinal direction of the charging roller to press the charging roller against the photoconductor during one-way rotation of the photoconductor and the charging roller; and a control section for controlling return of the charging roller to a free state out of contact with the pressing section, wherein the pressing section is inclined with respect to a direction of a line connecting a center of a cross-sectional circle of the charging roller to an axis of the photoconductor, as seen from an axial direction of the photoconductor in a state that the charging roller contacts with the pressing section, the pressing section is inclined farther away from the photoconductor toward an upstream of the one-way rotation of the photoconductor, and the charging roller, when pressed by the pressing section against the photoconductor during the one-way rotation of the photoconductor and the charging roller, assumes a generally elliptical shape in cross-section.

2. The image forming unit set forth in claim 1, wherein the center of the charging roller is positioned within 90 degrees of a central angle between a datum straight line, which connects the axis of the photoconductor to a top of the photoconductor, and a horizontal line passing through the axis of the photoconductor on a downstream side of the one-way rotation of the photoconductor, as seen from the axial direction of the photoconductor in the state that the charging roller contacts with the pressing section.

3. The image forming unit set forth in claim 1, further comprising:

a pressing member for pressing the charging roller against at least the photoconductor or both the pressing section of the regulating member and the photoconductor.

4. The image forming unit set forth in claim 3 wherein the control section moves the pressing member in a direction away from the charging roller so that the charging roller may return to the free state at an end of image formation.

5. The image forming unit set forth in claim 3, wherein the control section moves the regulating member in a direction away from the charging roller so that the charging roller may return to the free state at an end of image formation.

6. The image forming unit set forth in claim 3, wherein the pressing member is attached to the regulating member, and the image forming unit comprises a control section moves the regulating member together with the pressing member in a direction away from the charging roller so that the charging roller may return to the free state at an end of image formation.

7. The image forming unit set forth in claim 1, wherein the regulating member has a contact surface which contacts with the charging roller during the one-way rotation of the photoconductor and the charging roller, and a plane including the contact surface intersects the axis of the photoconductor.

8. The image forming unit set forth in claim 1, wherein the control section inversely rotates the photoconductor at an end of image formation.

9. The image forming unit set forth in claim 1, wherein the charging roller is a hollow roller.

10. The image forming unit set forth in claim 1, wherein the control section moves the regulating member in a direction away from the charging roller so that the charging roller may return to the free state at an end of image formation.

11. The image forming unit set forth in claim 10, wherein the control section stops rotation of the photoconductor at an end of image formation and moves the regulating member in a direction away from the charging roller after prescribed time elapses.

12. The image forming unit set forth in claim 10, wherein the control section moves the regulating member in a direction closer to the charging roller at a start of image formation and starts rotation of the photoconductor after prescribed time elapses.

13. The image forming unit set forth in claim 1, wherein frictional resistance of the photoconductor against the charging roller is equal to or larger than frictional resistance of the regulating member against the charging roller.

14. The image forming unit set forth in claim 1, wherein a slide member is provided in a contact portion of the regulating member which contacts with the charging roller.

15. The image forming unit set forth in claim 1, wherein the regulating member is formed in such a size as to house the charging roller in the free state.

16. An image forming apparatus comprising the image forming unit set forth in claim 1.

* * * * *

UNITED STATES PATENT AND TRADEMARK OFFICE

CERTIFICATE OF CORRECTION

PATENT NO. : 8,463,159 B2
APPLICATION NO. : 12/393130
DATED : June 11, 2013
INVENTOR(S) : Hidekazu Nakagami et al.

It is certified that error appears in the above-identified patent and that said Letters Patent is hereby corrected as shown below:

In the Claims:

Column 14, Line 63

Claim 6 should read as follows:

6. The image forming unit set forth in claim 3, wherein the pressing member is attached to the regulating member, and the control section moves the regulating member together with the pressing member in a direction away from the charging roller so that the charging roller may return to the free state at an end of image formation.

Signed and Sealed this
Twenty-fourth Day of September, 2013

Teresa Stanek Rea
*Deputy Director of the United States Patent and Trademark Office*